US006331109B1

(12) United States Patent
Paikert et al.

(10) Patent No.: US 6,331,109 B1
(45) Date of Patent: Dec. 18, 2001

(54) PREMIX BURNER

(75) Inventors: Bettina Paikert, Oberrohrdorf; Christian Steinbach, Neuenhof; Richard Straessle, Aarau, all of (CH); Dieter Winkler, Lauchringen (DE)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/624,258

(22) Filed: Jul. 24, 2000

(30) Foreign Application Priority Data

Jul. 22, 1999 (EP) ..... 99114376

(51) Int. Cl.[7] ..... F23D 14/46

(52) U.S. Cl. ..... 431/350; 431/351; 431/354; 60/39.31; 60/39.32; 60/752

(58) Field of Search ..... 431/350–354, 431/181, 182, 187, 188, 8.9, 166, 167, 243; 60/39.23, 737, 752, 756, 757, 39.31, 39.32

(56) References Cited

U.S. PATENT DOCUMENTS

| | | | |
|---|---|---|---|
| 5,129,231 | | 7/1992 | Becker et al. . |
| 5,307,634 | | 5/1994 | Hu . |
| 5,363,643 | | 11/1994 | Halila . |
| 5,954,490 | * | 9/1999 | Knopfel et al. ..... 431/350 |
| 6,019,596 | * | 2/2000 | Knopfel et al. ..... 431/350 |

FOREIGN PATENT DOCUMENTS

| | | |
|---|---|---|
| 0321809B1 | 5/1991 | (EP) . |
| 0780629A2 | 6/1997 | (EP) . |
| 0908671A1 | 4/1999 | (EP) . |
| 0918190A2 | 5/1999 | (EP) . |
| WO93/17279 | 9/1993 | (WO) . |

* cited by examiner

*Primary Examiner*—James C. Yeung
(74) *Attorney, Agent, or Firm*—Burns, Doane, Swecker & Mathis, L.L.P.

(57) ABSTRACT

A premix burner consisting essentially of a swirl generator for a combustion air stream or another gaseous oxidizing medium and of conduits for injecting fuel into the swirl flow thus generated. As a result of a discontinuous cross-sectional widening at the transition to the combustion space, the swirl flow bursts open and a backflow bubble is formed, which serves for flame stabilization. For use under extreme thermal conditions, the burner front is provided with a heat shield which is fastened to a carrier structure in such a way as to allow, as unimpeded as possible, differential thermal expansions. The carrier structure is preferably provided with orifices, through which cooling air for the impact cooling of the heat shield flows. In a preferred variant, the fuel gas supply is designed as pipes which are led through orifices of the swirl generator without any fixed connection. As a result of this design, thermal stresses in the material of the burner are avoided as far as possible.

44 Claims, 9 Drawing Sheets

PREMIX BURNER

This application claims priority under 35 U.S.C. §§119 and/or 365 to Appln. No. 99114376.9 filed in Europe on Jul. 22, 1999; the entire content of which is hereby incorporated by reference.

FIELD OF THE INVENTION

The invention relates to premix burners according to the preamble of the independent patent claim.

BACKGROUND OF THE INVENTION

EP 0 321 809, EP 0 780 629 or WO 93/17279 in each case disclose premix burners for operating with gaseous and/or liquid fuels, these burners having essential features in common. Thus, in each case, a swirl generator having tangential air inflow orifices encloses a cavity, the cross-sectional area of which widens in the axial flow direction. In EP 0 321 809 and EP 0 780 629, this is implemented by the swirl generator being of conical design, whilst the fully equivalent solution proposed in WO 93/17279 is to make the swirl generator itself cylindrical and insert inside the cavity a conical displacement body narrowing in the axial throughflow direction. Fuel is supplied to the swirl flow within the swirl generator. It is known for means for supplying a liquid fuel to be arranged in the vicinity of the burner axis and for means for introducing gaseous fuels to be provided radially on the outside, preferably in the region of the tangential air inflow orifices. The introduction of the fuels into a highly swirled flow is aimed at good premixing of the fuel/air mixture, and, of course, the axial component of the flow velocities must be so high that the flame does not flash back into the cavity of the burner. For further intensifying the intermixing of fuel and air, EP 0 780 629 proposes that the swirl generator be followed by a mixing section and that the swirl flow be transferred into this mixing section, if possible, without any loss. At a downstream end, the burner types mentioned issue with a more or less sudden widening of the flow cross section, at a short axial distance, in a combustion space. The highly swirled flow bursts open at this sudden jumping cross section, and a backflow bubble is formed, which causes a flame to be stabilized, without mechanical flame holders which are at risk from latent heat.

Burners of the type known from EP 0 321 809 have proved appropriate for many years in practical applications in gas turbines and atmospheric firing installations. The burners known from EP 0 321 809 and from EP 0 780 629 have undergone constant further development, and improvement proposals are found in a multiplicity of published documents.

However, another result arising from the functioning of the burners is that they build up high thermal stresses during operation. Thus, a burner of this type has a front plate, on which the swirl generator and, if appropriate, a mixing tube are mounted. In this case, the front plate constitutes the closure of the burner to the combustion space and separates from the combustion space a space from which air flows through the tangential orifices into the interior of the burner. In this case, both a leakage of combustion air and an uncontrolled penetration of smoke gases into the fresh air are to be avoided under all circumstances. Moreover, the entire burner has to be anchored in some way to the combustion space wall. Consequently, in the burners known at the present time, the swirl generator or, if present, a mixing tube is connected fixedly to the front plate, for example by welding. The front plate is then subjected, during operation, to hot combustion gases, whilst the rest of the structure is surrounded by a medium having a markedly lower temperature. The swirl generator and the mixing tube impede the free thermal expansion of the front plate, and high mechanical stresses are induced, precisely at the connection point which for manufacturing reasons is often a weld seam.

In modern gas turbines, the temperatures of the combustion air reach an order of magnitude of around 500° C. However, with a rising pressure ratio of the working process or with pronounced external preheating of the combustion air, both of these being measures having a beneficial influence on the process efficiency, efficient cooling of the front plate is obviously more complicated to carry out.

It remains to be said, in conclusion, that, with a further rise in key process data, a limitation of the useful life of premix burners must be expected in the embodiments known at the present time, specifically, on the one hand, because of thermal stresses in the components due to impeded thermal expansion and, on the other hand, because the cooling of components exposed to hot gas will be always more complicated to achieve satisfactorily.

SUMMARY OF THE INVENTION

The invention is intended to remedy this. The object on which the invention, is based is to design a premix burner of the type initially mentioned, in such a way that relative displacements of the individual components of the burner due to thermal expansions can take place, unimpeded. Furthermore, the cooling of parts exposed to hot gas is to be ensured or parts not capable of being cooled effectively are to be protected against excessive thermal loads.

The essence of the invention, therefore, is for the front plate to be designed as a carrier structure, on which the swirl generator or, if appropriate, a mixing tube following the swirl generator is fastened. As already discussed with regard to the prior art, it is expedient, for various reasons, to connect these structural components firmly to the carrier structure. According to the invention, a heat shield is arranged downstream of the carrier structure, said heat shield being connected to the carrier structure in such a way that, within the limits of the thermal expansions to be expected, the free relative displaceability of the carrier structure and heat shield is impeded only slightly. This design affords a series of advantages. The front plate, which designed as a carrier structure is subjected to thermal load to a substantially lesser extent. As a result, substantially less cooling is necessary in order to maintain the carrier structure at a temperature which is compatible with that of the adjacent components of the burner. Under some circumstances, a special ceramic heat protection coating of the carrier structure may even be dispensed with, and therefore materials with compatible coefficients of thermal expansion are used at this point. By contrast, it would be conceivable to produce the heat shield, which naturally does not have to bear any mechanical loads, from a solid ceramic resistant to high temperature, and to dispense with cooling completely. Since largely unimpeded relative displaceability of the carrier structure and heat shield is ensured, in principle materials with completely different coefficients of thermal expansion may be used here.

The possible necessary cooling of the carrier structure and that of the heat shield may be combined in an expedient way. For this purpose, the carrier structure is provided with a multiplicity of orifices, through which a cooling medium, usually preferably air, flows out toward the combustion space. The carrier structure thus serves as a perforated plate for impact cooling of the heat shield, whilst the coolant flowing through simultaneously absorbs heat from the carrier structure. The interspace between the carrier structure and the heat shield is then designed as a cooling duct which is advantageously subdivided by means of a continuous web in order to avoid radial flows.

If the design conditions allow it, the carrier structure may itself be connected directly to the combustion chamber wall. Should the temperature distributions in the combustion space walls not allow it or allow it only in a disadvantageous manner, the carrier structure is held on the combustion space wall preferably by means of a number of tubes or rods oriented upstream of the carrier structure. This likewise ensures the absorption of thermal expansions. If these tubes are led through the heat shield in the axial flow direction, they may be utilized as a fuel gas supply for a so-called pilot mode of the burner. In this operating state, the fuel/air mixture of the burner is too lean for stable premix combustion. Gaseous fuel is then not only supplied to and premixed with the swirl flow, but the fuel is also introduced through said tubes into the combustion space and burnt in a diffusion flame. In this case, although substantially larger quantities of nitrogen oxides than during premix combustion occur, the diffusion flame is nevertheless far more stable than a premix flame at high air ratios.

At very high combustion air temperatures, for example above 500° C., critical thermal expansion ratios may also occur in the region of a fuel gas supply for the premixing operation of the burner when, as is customary nowadays, the gas supply line is connected firmly to the swirl generator of the burner or is integrated into this. To be precise, whereas the combustion air at very high temperature flows around the swirl generator and the components of the latter assume the temperature of the combustion air, the fuel lines have flowing through them fuel gas which, for various reasons, can be preheated only to comparatively low temperatures. Consequently, in turn, high temperature gradients in the material of the burner and therefore considerable mechanical loads due to differential expansions are established in this region. It is therefore proposed that, for premixing operation, the supply of gaseous fuel be uncoupled mechanically from the swirl generator. Advantageously, instead of as in the conventional designs, a fuel line with a multiplicity of gas bores is to be integrated into the swirl generator, the swirl generator is provided with a series of orifices and fuel lines for gas premixing operation are designed as pipelines which project through those very orifices into the interior of the swirl generator and there supply gaseous fuel to the swirled flow of combustion air. Preferably, at least one gas supply pipe is arranged for each tangential inlet slit of the swirl generator. The open ends of the gas lines are advantageously designed as nozzles.

Swirl generator geometries which are preferred in connection with the invention may be gathered from the subclaims. The invention may be implemented equally in the case of premix burners with or without a mixing section following the swirl generator.

Preferred embodiments of the invention are disclosed in the following description and illustrated in the accompanying drawings, in which:

Figure 1:
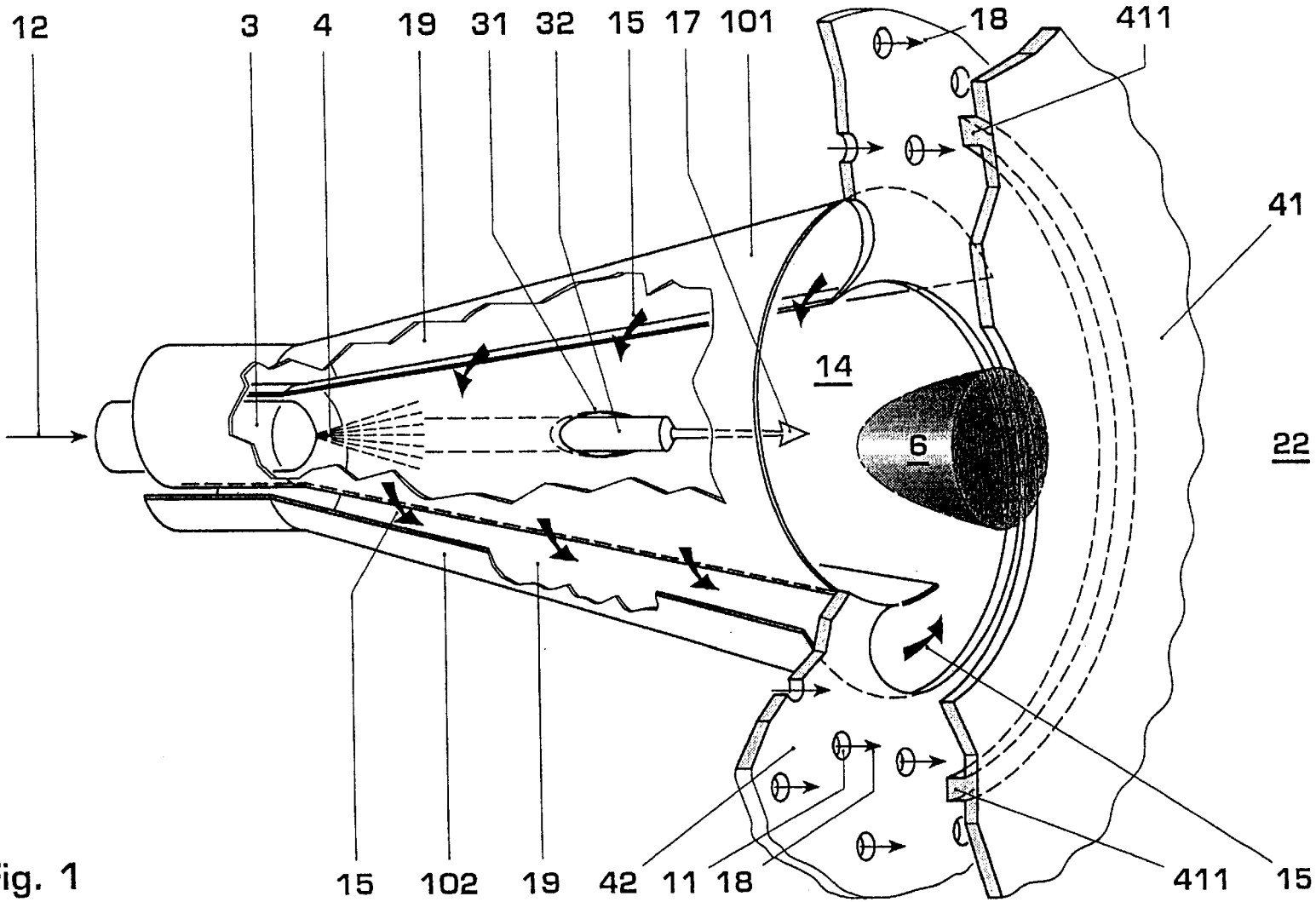
FIG. 1 and FIG. 2 show a perspective view of a premix burner according to the invention in two different types of illustration.

The exemplary embodiments illustrated in the drawing and discussed below are to be understood merely by way of illustration. The exemplary embodiments show a few preferred variants of the invention. They do not claim to illustrate exhaustively all the embodiments of the invention, as defined in the claims, and are not to be understood restrictively.

DETAILED DESCRIPTION OF THE INVENTION

A first preferred embodiment of a premix burner according to the invention is found in FIG. 1. This is essentially the premix burner which is known from EP 0 321 809, the swirl generator of which consists of cone half bodies 101, 102 nested one in the other. The burner is illustrated partially in section here. The part bodies 101, 102 enclose a cavity 14, the cross section of which widens in the axial direction of the burner toward the combustion space 22. A gaseous oxidizing medium 15, generally air or another gas containing oxygen, flows through tangential slits 19, which extend in the axial direction of the burner, into cavity 14. A swirl flow is formed in the cavity 14. At the transition into the combustion space 22, the flow experiences a sudden sharp widening of the axial flow cross section, and the swirl flow becomes unstable and collapses. As a result of this so-called "vortex breakdown", a backflow bubble 6, which can be utilized for stabilizing a flame, is formed at the issue of the burner into the combustion space. For this purpose, at least one fuel is admixed with the swirl flow within the cavity 14. In the example, an atomizer nozzle 3, which is arranged centrally on the upstream side of the burner and is supplied with a liquid fuel 12, is provided and introduces a liquid fuel spray 4 into the swirl flow. Furthermore, the part bodies 101, 102 of the swirl generator are provided with orifices 31. Pipes 32 are led through these orifices. These pipes are held externally in a way which is not illustrated here and which is not essential to the invention. By contrast, there is no fixed connection between a pipe 32 and one of the part bodies 101, 102 of the swirl generator. A fuel for the premixing operation of the burner is delivered, together with gaseous fuels 17, via the pipes 32 and is introduced into the swirled combustion air 15. Preferably, the end of the pipe out of which the fuel flows is of slightly nozzle-shaped design. This influences the pressure and flow conditions in such a way that no fuel flows along on the outer wall of the pipe 32 through the orifice 31 back into the space outside the burner.

Figure 2:
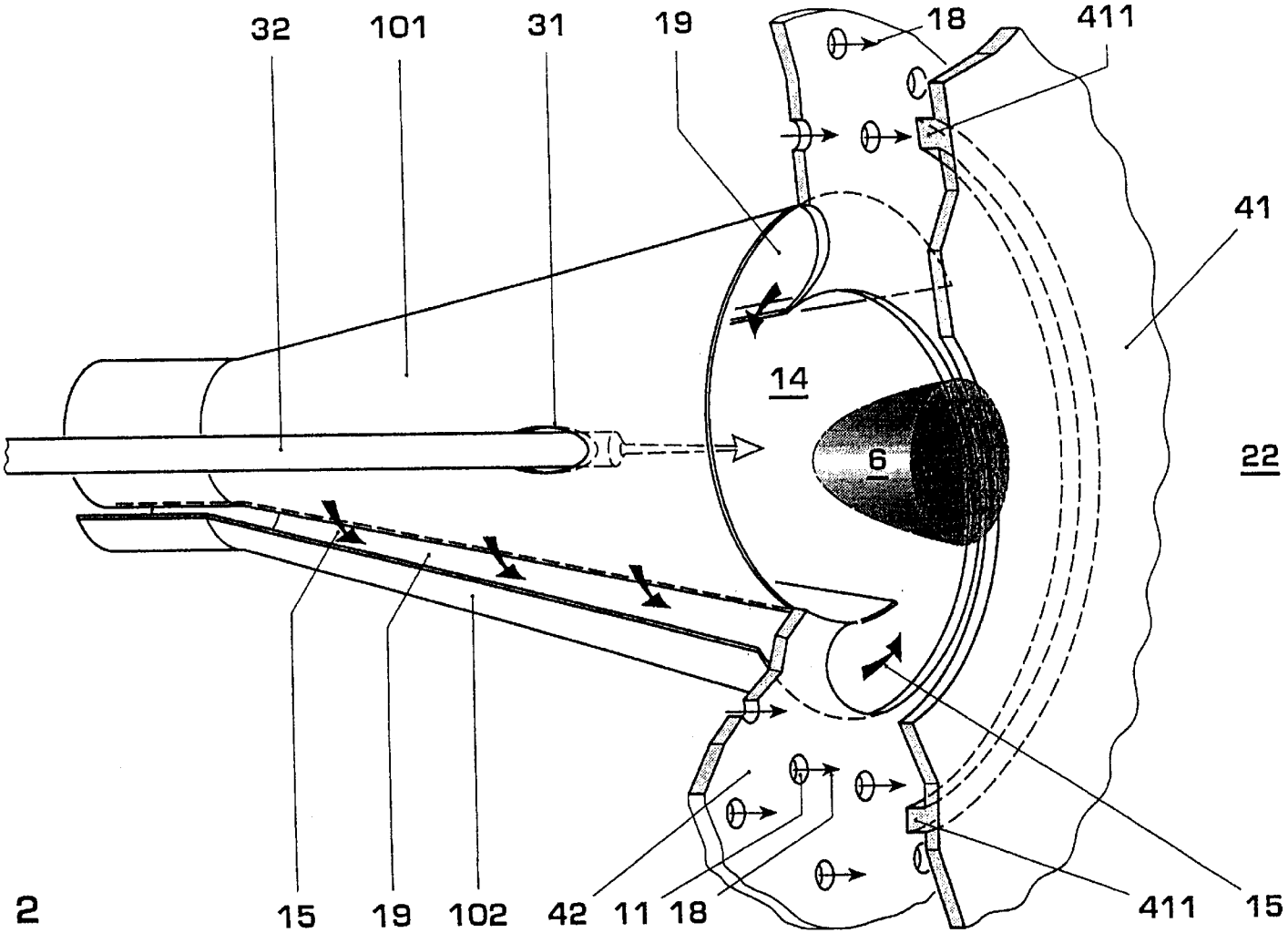

FIG. 2 illustrates the same burner, but not in section. For the sake of greater clarity, the liquid fuel supply is not illustrated. It can be seen clearly, in FIG. 2, how a gas supply pipe 32 is led from the outside through the orifice 31 of the swirl generator part body 101.

The external mounting of the gas supply pipe 32, without fastening to the components of the swirl generator, has substantial advantages when the burner is used under appropriate thermodynamic conditions. The combustion air 15 reaches temperatures of several hundred degrees centigrade. In today's terms, 500° C. is somewhat on the conservative side, whilst temperatures of around 700° C. are mentioned in conjunction with higher pressure conditions of the working processes of gas turbines and external combustion air preheating. By contrast, a possible preheating temperature of the gaseous fuels is limited, for example, to 150° C. or 200° C. Consequently, the swirl generator part bodies and the gas supply pipes 32 have greatly differing temperatures and thermal expansions during operation. When a gas supply, then, is connected fixedly to a swirl generator part body, high thermal stresses, which at least curtail the useful life of the burner, are established, during operation, on account of impeded thermal expansions.

The invention may, of course, also be implemented if the gas supply lines for the premixing operation are produced in another way, for example in the conventional design known from EP 0 321 809, and are connected fixedly to the swirl generator. EP 0 908 671 discloses a further variant of the fuel gas supply which closely resembles that used here. However, there too, the gas supply lines are connected fixedly to the swirl generator. This does not per se contradict the idea of the invention and is not contrary to the implementation of the invention. Within the spirit of the invention, however, it is advantageous and logical, in actual fact, to avoid heat stresses at this point too, by means of a mechanical uncoupling of the swirl generator from the gas supply. This variant of the premixing gas supply was also selected in the following exemplary embodiments, but this does not constitute any restriction! It would also be possible to produce a burner according to the invention entirely without a gas supply, solely for operating with liquid fuel. However, a person skilled in the art derives such variants from the teaching of the present document with complete freedom, which is why they are not explained.

Both in FIG. 1 and in FIG. 2, it can be seen that the burner front part facing the combustion space 22 is constructed in two parts. The swirl generator is affixed to a carrier structure 42, whilst a heat shield 41, having no direct large-area contact with the carrier structure 42, protects the latter against direct contact with hot gas within the combustion space 22. The carrier structure is itself provided with a number of bores 11, through which a cooling medium 18, preferably the oxidizing medium, flows into an interspace, designed as a cooling duct, between the carrier structure and the heat shield. The carrier structure therefore serves at the same time as a perforated plate for the impact cooling of the heat shield and is itself cooled by the coolant 18 flowing through. The cooling duct, in turn, is divided in the radial direction by means of a continuous web 411 which runs in the circumferential direction of the burner and which may be arranged both on the heat shield and on the carrier structure. Due to this subdivision, harmful radial flows, as a result of which hot gases may penetrate into the cooling duct, are avoided. The heat shield is fastened to the carrier structure by means of bolts which are not shown in the illustration in FIG. 1 and FIG. 2. The relatively soft fastening by means of a few bolts ensures at least partial compensation of different thermal expansions, which is why these do not lead to pronounced mechanical stresses. Furthermore, the carrier structure, on which the swirl generator is mounted, is protected against the introduction of excessive heat. As a result, its temperature differs insignificantly from that of the swirl generator part bodies, and because of this excessive rises in stress due to different thermal expansions are avoided even at the connection point between the swirl generator and the carrier structure.

Figure 3:
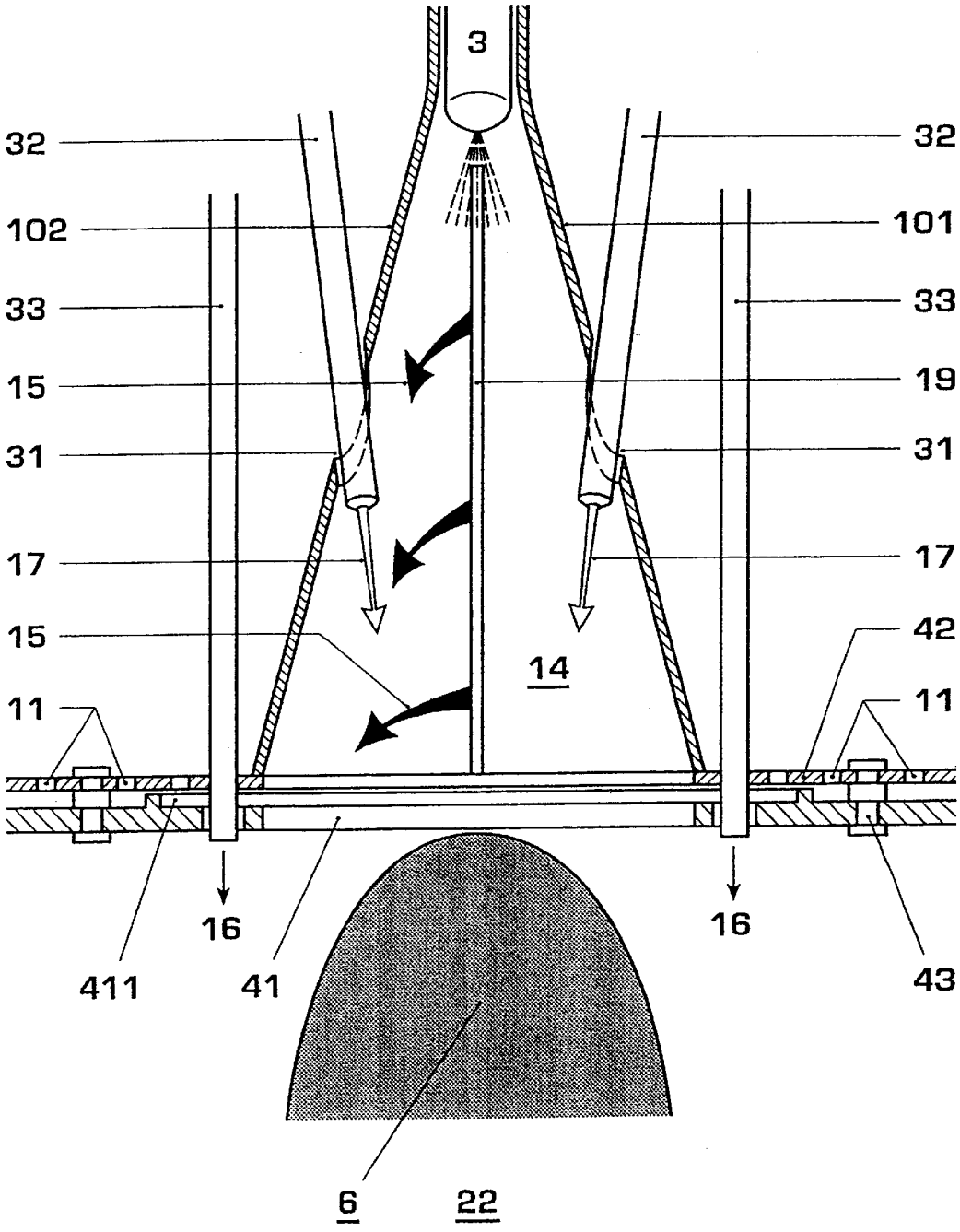
FIG. 3 shows a premix burner according to the invention in longitudinal section.

The burner illustrated in perspective in FIGS. 1 and 2 is shown in longitudinal section in FIG. 3. In particular, the configuration of the burner front can be seen clearly in this illustration. The swirl generator is connected fixedly to the carrier structure 42. Mounted on this by means of bolts 43 is the heat shield 41 which has a continuous web 411 between the carrier structure and the heat shield. The bolt connection may be designed, here, in such a way that relative displacement between the carrier structure and the heat shield is only slightly impeded.

If required, the carrier structure is also not fastened directly to the combustion space wall, but is likewise fastened to the combustion space wall by means of pipes or rods 33, in such a way, here too, that relative movements due to thermal expansions are only slightly impeded. In a preferred variant, mountings are designed as pipes which are prolonged on the end side of the carrier structure toward the combustion space and are led through the heat shield. These pipes 33 may be utilized for supplying a gaseous fuel 16 for the so-called pilot mode. When the burner air ratio is very high, the quantity of gaseous fuel is no longer sufficient to ensure a stable premix flame in the event of supply via the premixing gas supply 32. In such an operating state, the gas quantity is supplied as so-called pilot gas 16 via the lines 33 and is then burnt in a diffusion flame. Although, on the one hand, the latter generates markedly more nitrogen oxides, it is nevertheless far more stable than a premix flame at high burner air ratios.

Figure 4:
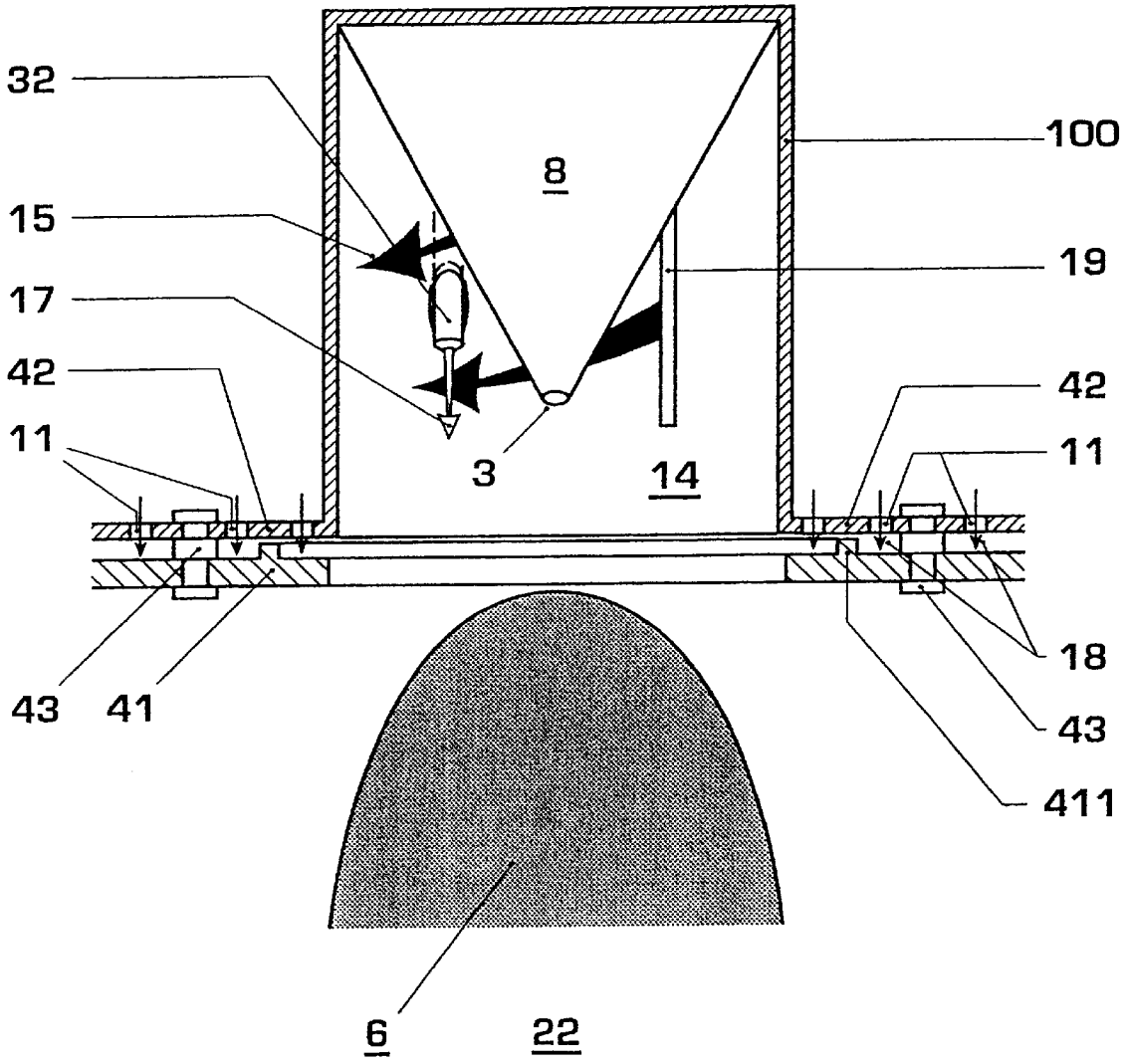
FIG. 4 shows a premix burner with an alternative design of the swirl generator.

FIG. 4 shows a burner according to the invention with an alternative swirl generator design which, however, has entirely the same effect. To be precise, in contrast to the swirl generator designs illustrated above, the swirl generator 100 is not conical, but cylindrical. In this design, the widening of the flow cross section of the burner cavity 14 is achieved in that a conical displacement body 8, which narrows in the axial flow direction, is located inside the burner. It should be mentioned expressly that a widening swirl generator may, of course, also be combined with a displacement body. In the extreme case, even a swirl generator narrowing in the axial flow direction could be used, in which a displacement body narrowing even more sharply is inserted. As a corresponding design, the throughflow cross section of the cavity 14 in the swirl generator is nevertheless increased. A liquid fuel nozzle 3, not necessary arranged directly at the cone vertex, as illustrated here, may be arranged in this displacement body. As in the exemplary embodiments shown above, here too, a gaseous fuel 17 for premixing operation is introduced into the swirled combustion air 15 via lines which do not have any rigid connection to the swirl generator 100. In this example, the tangential inflow slit 19 is not continued directly as far as the burner mouth; it may be said that the swirl generator is followed, downstream as far as the burner mouth, by a mixing section. This point is discussed in more detail below. As in the burners with a swirl generator of divergent design, in the burner with a cylindrical swirl generator, too, the premixed swirl flow bursts open during the sudden transition in cross section from the burner interior to the combustion space 22 and thus produces the backflow zone 6 which finally causes a flame to be stabilized.

Figure 5:
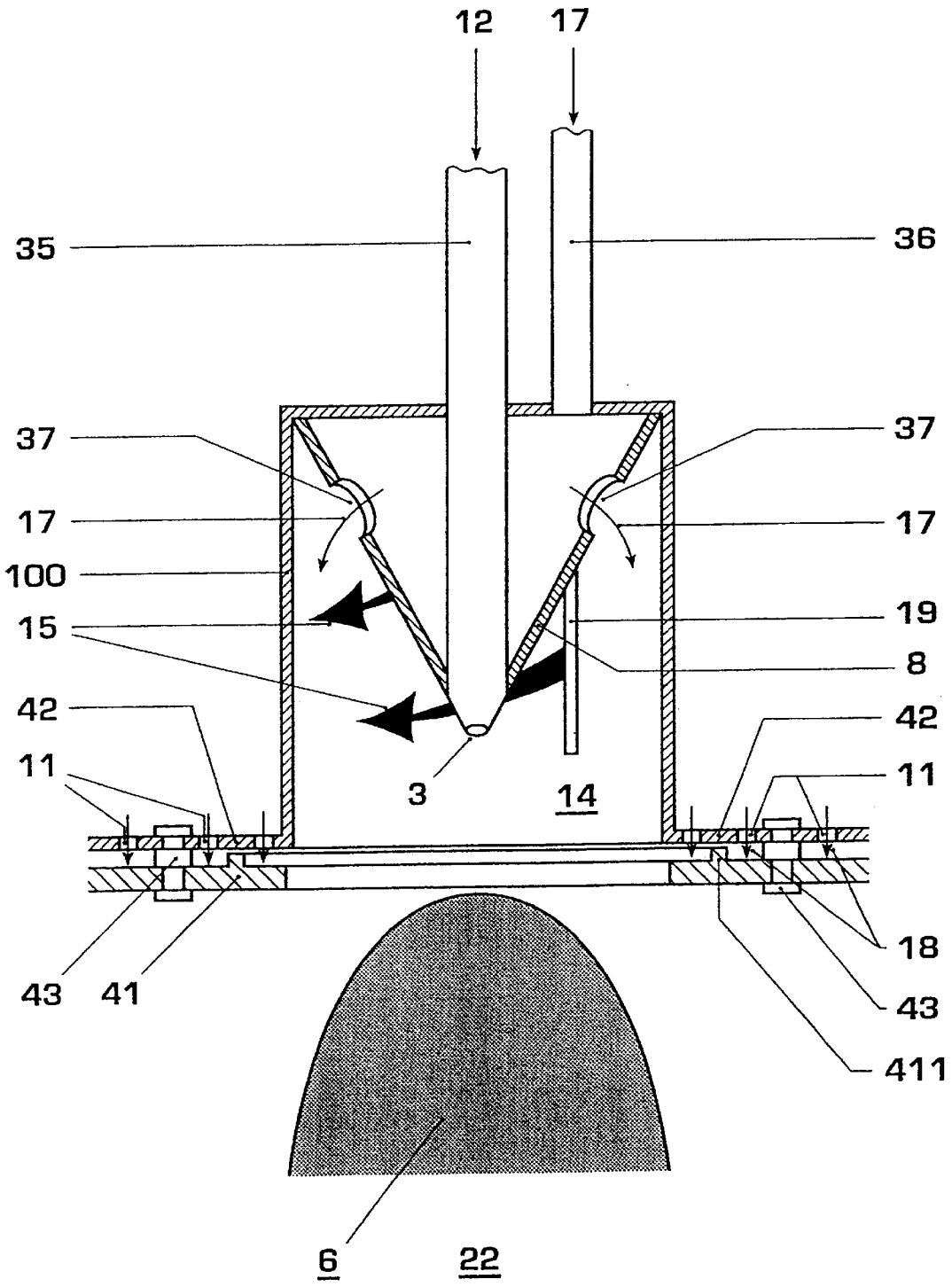
FIG. 5 shows a premix burner according to the invention with the swirl generator design from FIG. 4, with another variant of the fuel supply.

A further preferred embodiment of a burner with a cylindrical swirl generator is illustrated in FIG. 5, in this embodiment the displacement body being utilized completely for the fuel supply. A line 35 conducts a liquid fuel 12 through the displacement body 8 as far as a liquid fuel nozzle 3. At a downstream end, the displacement body is closed off. A gaseous fuel 17 for premixing operation is supplied by means of a line 36 into the cavity thus obtained and is admixed with the swirled combustion air 15 via a number of orifices 37 in the displacement body. In this version, although thermal stresses in the region of the premixing gas supply are not avoided perfectly, they are nevertheless markedly lower than in the prior art.

As these examples show, in a burner according to the invention the axial run of the swirl body contour, in combination with an inner displacement body, can be varied within large limits. In particular, the displacement body, too, may have a series of different contours in the direction of the burner longitudinal axis, without the essence of the invention being affected. It is critical that, in the interaction of the swirl generator and displacement body, the axial throughflow cross section within the swirl generator increases.

Figure 6:
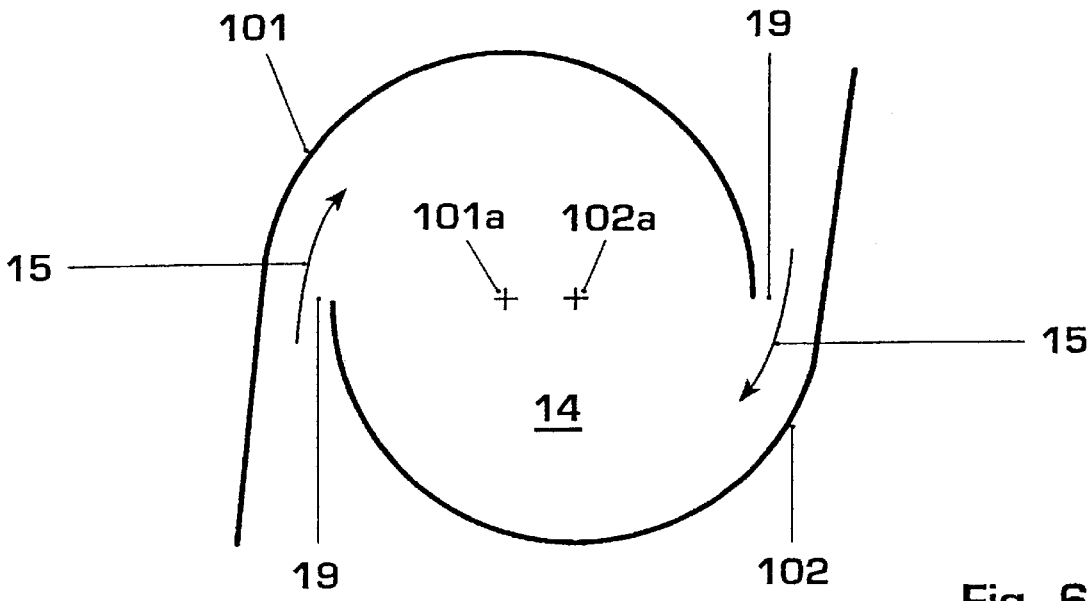
FIG. 6 to FIG. 9 show cross sections through possible embodiments of swirl generators.
Figure 7:
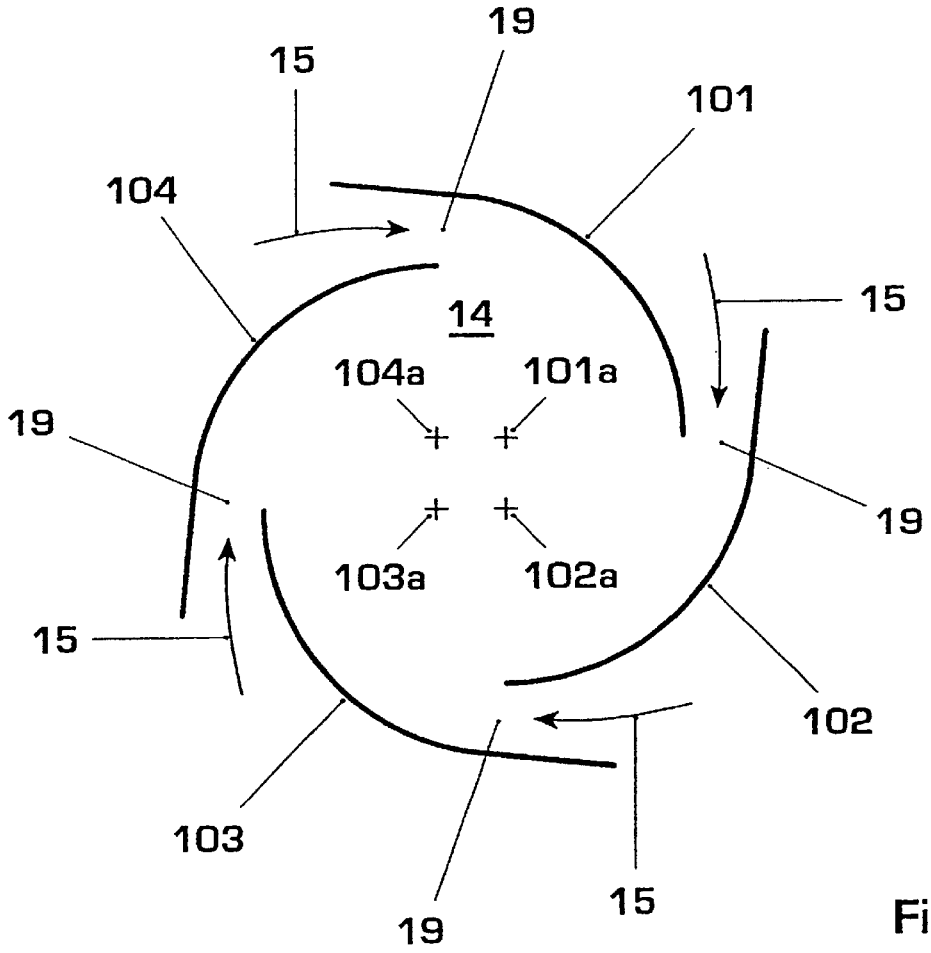
Figure 8:
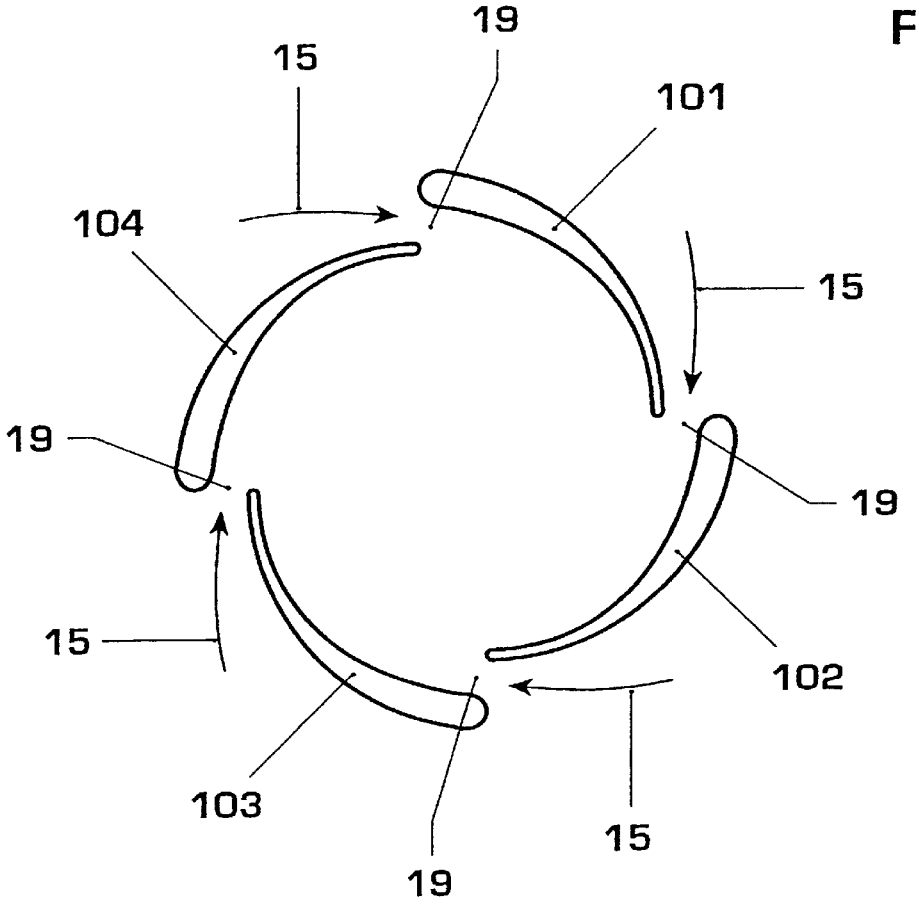

Just as the axial contour of the swirl generator may be varied within very wide ranges, of course specific geometries being preferable for fluidic or manufacturing reasons, the cross-sectional design of the swirl generator may also be adapted, within wide limits, to specific conditions, for example fluid-dynamic, reaction-kinetic or manufacturing requirements. FIGS. 6 to 9 give a hint of the multiplicity of possible geometries. In FIG. 6, the swirl generator consists of two part bodies 101, 102 of semicircular cross section, each with an entry guide section. The center axes 101*a*, 102*a* of the two part bodies are different from one another, thus giving rise to the tangential inlet orifices 19. The part bodies may, of course, also be spiral or elliptic or even oval, instead of being semicircular, the choice of which influences the fine structure of the swirl flow in the swirl generator cavity. The swirl generator may also consist of more than two part bodies offset relative to one another, as illustrated in FIG. 7. FIG. 8 illustrates, in cross section, a swirl generator consisting of four aerodynamic blade profiles 101, 102, 103, 104 which are arranged in such a way that tangential inflow orifices 19 are likewise obtained. It would be conceivable, in principle, for the part bodies to be designed pivotably, in order thereby to implement a variable geometry of the inlet orifices 19. Finally, in FIG. 9, the swirl generator 100 is designed as a monolithic component, into which tangential slits 19 are cut by milling or are introduced by means of another machining method. All the examples from FIGS. 6 to 9 may, of course, be designed with any desired axial contour of the swirl generator and with or without an inner displacement body.

Figure 11:
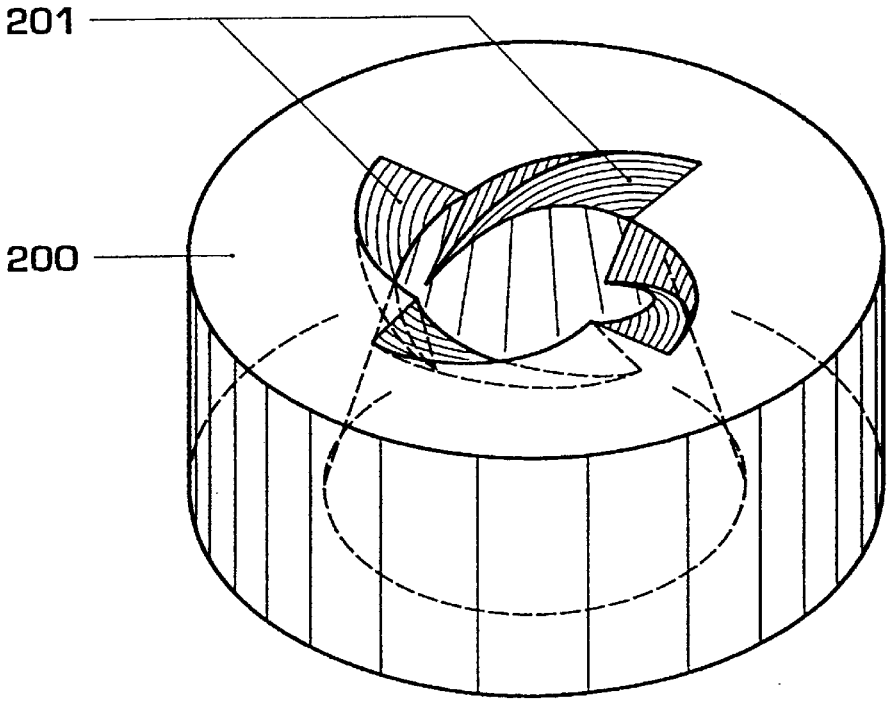
FIG. 11 shows an enlarged illustration of an element from FIG. 10.
Figure 9:
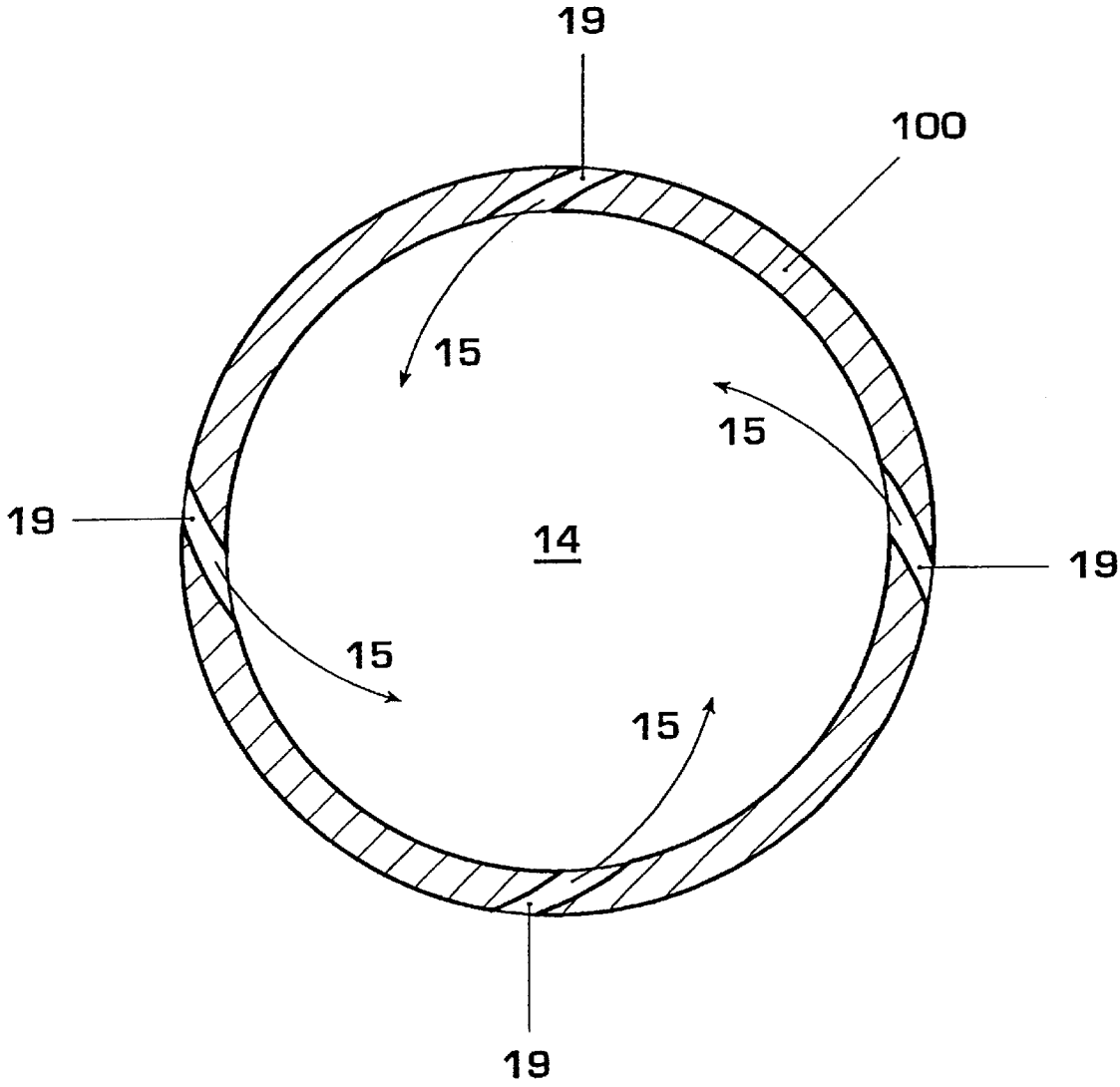
Figure 10:
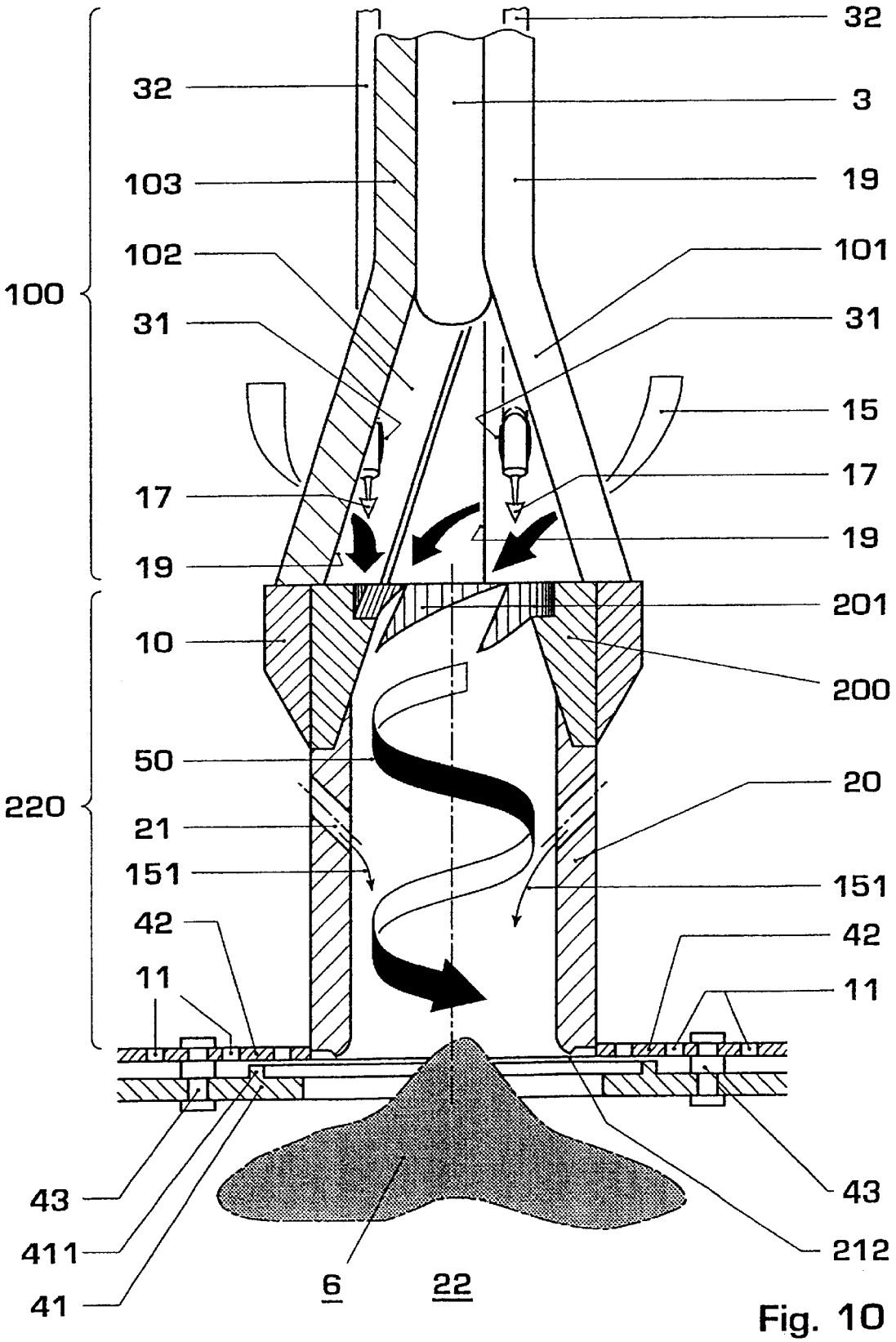
FIG. 10 shows a premix burner with all the features essential to the invention and with a mixing tube following the swirl generator.

In a further preferred version (FIG. 10) of the burner according to the invention, a swirl generator 100 is followed, in the axial throughflow direction of the burner, by a mixing section 220 for improved intermixing of fuel and combustion air. The swirl generator is illustrated as a conical swirl generator consisting of four swirl generator part bodies, of which, in the selected section taken, two part bodies 101, 102 can be seen completely and the part body 103 partially. Once again, each part body contains a leadthrough 31 for a premixing gas line 32, in which a gaseous fuel 17 can be supplied for the gas premixing operation of the burner. In the selected illustration, only two of the four premixing gas lines can be seen, specifically those which are led through the part bodies 101 and 102. Once again, these lines are of slightly nozzle-shaped design at their end. A backflow of fuel through the leadthrough orifices 31 is thereby prevented. The burner is still capable of being operated with liquid fuel via a central fuel nozzle 3. Downstream of the swirl generator, the latter has adjoining it a transition piece 200 which is illustrated on an even larger scale in FIG. 11. On the inner wall of the transition piece, the wall geometry is such that the swirl flow 50 formed in the swirl generator is transferred into a mixing tube 20 as far as possible without any loss. A number of crossover ducts 201 are also machined in the transition piece 200 and lead the flow, which flows out of each tangential inflow slit 19 into the burner interior 14, from the swirl generator to the mixing tube, at the same time avoiding discontinuities in the wall contour. The transition piece is installed in a mounting ring 10 which carries the swirl generator 100, the transition piece 200 and the mixing tube 20. Tangential wall bores 21, through which an air quantity 151 flows into the mixing tube, are introduced in the mixing tube itself. This additional air prevents ignitable mixture from being present in the near-wall flow boundary layer, in which a flashback of a flame into the mixing tube could take place on account of the locally low flow velocity. The mixing tube issues with a small transition radius and a breakaway edge 212 into the combustion space 22. A continuous groove is machined in the end face of the burner radially outside the breakaway edge. By virtue of this special configuration, a breakaway bubble 6 is formed, with a comparatively large radial, but very small axial extent. As discussed in detail above, the front part of the burner shown by way of example is provided with a heat shield.

Although this invention has been illustrated and described in accordance with certain preferred embodiments, it is recognized that the scope of this invention is to be determined by the following claims.

What is claimed is:

1. A premix burner comprising:

an axial throughflow direction, an upstream end, and a downstream end, a swirl generator for swirling a gaseous oxidizing medium;

means for injecting at least one fuel into a swirl flow when generated by the swirl generator, the oxidizing medium flowing through the swirl generator into the premix burner when swirled by the swirl generator, said swirl generator having an axial throughflow direction, the swirl generator including and enclosing a cavity and having at least one tangential slit which runs in the axial throughflow direction and through which the oxidizing medium can flow in a tangential direction into the cavity, said cavity having a throughflow cross section, the cross-sectional area of said cavity at least partly increases toward the downstream end of the swirl generator;

a carrier structure;

a sudden cross-sectional increase at the downstream end of the premix burner, the premix burner being fastened at the downstream end of the premix burner to the carrier structure;

a heat shield arranged downstream of the carrier structure and fastened to the carrier structure so that there is no direct contact between the carrier structure and the heat shield and there is a distance between the carrier structure and the heat shield;

fastening means by which the heat shield is fastened to the carrier structure for ensuring relative displaceability between the heat shield and the carrier structure;

a displacement body in the cavity, the displacement body narrowing, at least in stages, toward the downstream end of the burner.

2. The premix burner as claimed in claim 1, wherein the axial throughflow direction of the swirl generator is identical to the axial throughflow direction of the premix burner.

3. The premix burner as claimed in claim 1, wherein the swirl generator comprises a monolithic hollow body including at least one tangential slit extending in the axial direction of the swirl generator.

4. The premix burner as claimed in claim 1, wherein the swirl generator comprises a plurality of part bodies, each part body including a longitudinal axis, the longitudinal axes of the part bodies arranged so as to be offset relative to one another and forming a tangential slit extending in the direction of the burner longitudinal axis between two of the plurality of part bodies.

5. The premix burner as claimed in claim 1, wherein the swirl generator has a cylindrical shape.

6. The premix burner as claimed in claim 1, wherein the swirl generator has a conicity such that the swirl generator widens continuously in diameter in its axial throughflow direction.

7. The premix burner as claimed in claim 1, further comprising means for introducing a liquid fuel into the swirl flow arranged adjacent to the burner axis.

8. The premix burner as claimed in claim 1, wherein the swirl generator comprises orifices, and further comprising pipes projecting through the orifices for injecting a gaseous fuel for the burner to operate with a premixed gas flame, said pipes being mechanically uncoupled from the swirl generator.

9. The premix burner as claimed in claim 8, wherein the pipes each have a nozzle at their end.

10. The premix burner as claimed in claim 1, further comprising at least one means for each slit of the at least one tangential slit, each means of the at least one means for injecting a gaseous fuel for the premix burner to operate with a premixed gas flame.

11. The premix burner as claimed in claim 1, wherein the displacement body comprises a closed-off hollow body having an upstream end which includes a connection for a gaseous fuel, said displacement body being provided with a plurality of orifices through which a gaseous fuel can be introduced into the cavity for operating the burner with a premixed gas flame.

12. The premix burner as claimed in claim 1, further comprising fastener means which extend from the carrier structure in the axial flow direction of the burner, and wherein the carrier structure is fastened to the combustion space wall by the fastener means.

13. The premix burner as claimed in claim 12, wherein the fastener means comprise pipes which extend through the heat shield, and wherein said pipes comprise supply lines for a gaseous fuel for operation with a gas diffusion flame.

14. The premix burner as claimed in claim 1, further comprising means for cooling the heat shield.

15. The premix burner as claimed in claim 1, wherein the carrier structure includes a multiplicity of orifices, through which a coolant can flow during operation, said orifices oriented and arranged so that the coolant can deliver both convective cooling of the carrier structure and impact cooling of the heat shield.

16. The premix burner as claimed in claim 15, further comprising the coolant and the oxidizing medium, and wherein the coolant is the same medium as the oxidizing medium.

17. The premix burner as claimed in claim 1, further comprising a cooling duct between the heat shield and the carrier structure.

18. The premix burner as claimed in claim 17, further comprising a continuous web which subdivides the cooling duct.

19. The premix burner as claimed in claim 1, further comprising a mixing section arranged downstream of the swirl generator.

20. The premix burner as claimed in claim 19, wherein the mixing section comprises a tubular mixing element having a longitudinal axis, the longitudinal axis of said tubular mixing element is substantially coincident with the burner axis.

21. The premix burner as claimed in claim 19, further comprising transition ducts for transferring the swirl flow when formed in the swirl generator into the mixing section are arranged in the axial flow direction of the burner, said transition ducts extending between the swirl generator and the mixing section in the flow direction.

22. The premix burner as claimed in claim 21, wherein the number of transition ducts corresponds to the number of tangential inlet slits.

23. A premix burner comprising:

an axial throughflow direction, an upstream end, and a downstream end;

a swirl generator for swirling a gaseous oxidizing medium;

means for injecting at least one fuel into a swirl flow when generated by the swirl generator, the oxidizing medium flowing through the swirl generator into the premix burner when swirled by the swirl generator, said swirl generator having an axial throughflow direction, the swirl generator including and enclosing a cavity and having at least one tangential slit which runs in the axial throughflow direction and through which the oxidizing medium can flow in a tangential direction into the cavity, said cavity having a throughflow cross section, the cross-sectional area of said cavity at least partly increases toward the downstream end of the swirl generator;

a carrier structure;

a sudden cross-sectional increase at the downstream end of the premix burner, the premix burner being fastened at the downstream end of the premix burner to the carrier structure;

a heat shield arranged downstream of the carrier structure and fastened to the carrier structure so that there is no direct contact between the carrier structure and the heat shield and there is a distance between the carrier structure and the heat shield;

fastening means by which the heat shield is fastened to the carrier structure for ensuring relative displaceability between the heat shield and the carrier structure;

wherein the swirl generator comprises orifices, and further comprising pipes projecting through the orifices for injecting a gaseous fuel for the burner to operate with a premixed gas flame, said pipes being mechanically uncoupled from the swirl generator.

24. The premix burner as claimed in claim 23, further comprising a displacement body in the cavity, the displacement body narrowing, at least in stages, toward the downstream end of the burner.

25. The premix burner as claimed in claim 24, wherein the displacement body comprises a closed-off hollow body having an upstream end which includes a connection for a gaseous fuel, said displacement body being provided with a plurality of orifices through which a gaseous fuel can be introduced into the cavity for operating the burner with a premixed gas flame.

26. The premix burner as claimed in claim 23, wherein the pipes each have a nozzle at their end.

27. The premix burner as claimed in claim 23, wherein the axial throughflow direction of the swirl generator is identical to the axial throughflow direction of the premix burner.

28. The premix burner as claimed in claim 23, wherein the swirl generator comprises a monolithic hollow body including at least one tangential slit extending in the axial direction of the swirl generator.

29. The premix burner as claimed in claim 23, wherein the swirl generator comprises a plurality of part bodies, each part body including a longitudinal axis, the longitudinal axes of the part bodies arranged so as to be offset relative to one another and forming a tangential slit extending in the direction of the burner longitudinal axis between two of the plurality of part bodies.

30. The premix burner as claimed in claim 23, wherein the swirl generator has a cylindrical shape.

31. The premix burner as claimed in claim 23, wherein the swirl generator has a conicity such that the swirl generator widens continuously in diameter in its axial throughflow direction.

32. The premix burner as claimed in claim 23, further comprising means for introducing a liquid fuel into the swirl flow arranged adjacent to the burner axis.

33. The premix burner as claimed in claim 23, further comprising at least one means for each slit of the at least one tangential slit, each means of the at least one means for injecting a gaseous fuel for the premix burner to operate with a premixed gas flame.

34. The premix burner as claimed in claim 23, further comprising fastener means which extend from the carrier structure in the axial flow direction of the burner, and wherein the carrier structure is fastened to the combustion space wall by the fastener means.

35. The premix burner as claimed in claim 34, wherein the fastener means comprise pipes which extend through the heat shield, and wherein said pipes comprise supply lines for a gaseous fuel for operation with a gas diffusion flame.

36. The premix burner as claimed in claim 23, further comprising means for cooling the heat shield.

37. The premix burner as claimed in claim 23, wherein the carrier structure includes a multiplicity of orifices, through which a coolant can flow during operation, said orifices oriented and arranged so that the coolant can deliver both convective cooling of the carrier structure and impact cooling of the heat shield.

38. The premix burner as claimed in claim 37, further comprising the coolant and the oxidizing medium, and wherein the coolant is the same medium as the oxidizing medium.

39. The premix burner as claimed in claim 23, further comprising a cooling duct between the heat shield and the carrier structure.

40. The premix burner as claimed in claim 39, further comprising a continuous web which subdivides the cooling duct.

41. The premix burner as claimed in claim 23, further comprising a mixing section arranged downstream of the swirl generator.

42. The premix burner as claimed in claim 41, wherein the mixing section comprises a tubular mixing element having a longitudinal axis, the longitudinal axis of said tubular mixing element is substantially coincident with the burner axis.

43. The premix burner as claimed in claim 41, further comprising transition ducts for transferring the swirl flow when formed in the swirl generator into the mixing section are arranged in the axial flow direction of the burner, said transition ducts extending between the swirl generator and the mixing section in the flow direction.

44. The premix burner as claimed in claim 43, wherein the number of transition ducts corresponds to the number of tangential inlet slits.

* * * * *